US005098079A

United States Patent [19]

Sanborn, III

[11] Patent Number: 5,098,079

[45] Date of Patent: Mar. 24, 1992

[54] APPARATUS FOR STACKING PIECES OF LIMP MATERIAL

[75] Inventor: Charles H. Sanborn, III, Shelbyville, Tenn.

[73] Assignee: Ark, Inc., Shelbyville, Tenn.

[21] Appl. No.: 580,203

[22] Filed: Sep. 10, 1990

Related U.S. Application Data

[63] Continuation-in-part of Ser. No. 550,455, Jul. 10, 1990, abandoned.

[51] Int. Cl.[5] ..... B65H 29/18

[52] U.S. Cl. ..... 271/176; 271/182; 271/190; 271/220; 271/308

[58] Field of Search ..... 271/190, 176, 182, 308, 271/199, 220

[56] References Cited

U.S. PATENT DOCUMENTS

| | | | |
|---|---|---|---|
| 596,073 | 7/1897 | Miehle | 271/190 |
| 2,065,301 | 12/1936 | Barber | 271/182 |
| 3,618,546 | 4/1970 | Preston | 112/121.29 |
| 3,841,625 | 10/1974 | Carricato | 271/182 |
| 3,933,352 | 12/1974 | Sinn | 271/189 |
| 4,157,823 | 6/1979 | Morton | 272/10 |
| 4,159,108 | 6/1979 | Haft | 271/190 |
| 4,395,037 | 5/1981 | Heine | 271/188 |
| 4,647,265 | 7/1985 | Uno | 414/115 |
| 4,790,224 | 8/1987 | Krutilla et al. | 83/53 |
| 4,807,866 | 2/1989 | Stemmle | 271/209 |

*Primary Examiner*—Richard A. Schacher

*Attorney, Agent, or Firm*—Senniger, Powers, Leavitt & Roedel

[57] ABSTRACT

Apparatus is disclosed for automatically stacking pieces of limp material including an endless conveyor having a forward traveling upper reach. The conveyor has a series of flights spaced at intervals therealong with spaces between the flights. Each flight is constructed for carrying one of the pieces thereon with the piece so positioned on the flight as to have a trailing end overhanging the trailing end of the flight. The apparatus further includes a platen or table at a stacking station along the length of the upper reach of the conveyor and below the upper reach for stacking pieces thereon one upon another and for holding the stack. A gripper mechanism is engageable with an upwardly facing surface of the piece for gripping the piece to stop it from moving forward. Thereafter, as the flight travels forward it moves out from under the piece and the piece is deposited at the station for accumulation of piece one on top of another on the table.

10 Claims, 6 Drawing Sheets 70
20
P
32
28L
28T
5
34
TE
104
106
110
112
114
116
118
74

APPARATUS FOR STACKING PIECES OF LIMP MATERIAL

The U.S. Government has a paid-up license in this invention and the right in limited circumstances to require the patent owner to license others on reasonable terms as provided for by the terms of contract No. DLA 900-87-C-0509 awarded by the Department of Defense.

This application is a continuation-in-part of U.S. application Ser. No. 07/550,455, filed July 10, 1990 now abandoned.

BRIEF SUMMARY OF THE INVENTION

This invention relates to automatic stacking apparatus for pieces of limp material, and more particularly to apparatus for automatically stacking pieces of fabric or the like one at a time and one after another from a conveyor.

Techniques and apparatus for manipulation of pieces of limp material have application in many areas of manufacturing. For instance, in the apparel industry, pieces of fabric, referred to herein as "plies", have many operations performed on them by automatic machinery at work stations as they are assembled into articles of apparel. The plies may be transported to and from the work stations, such as a sewing station, on a conveyor. After completing the operations to be performed on the individual plies by the various operating stations, the plies need to be organized such as in a stack for transfer to another location. Presently, plies of fabric are stacked by being pushed from the conveyor (or a work station along the conveyor) into a well, with the plies of fabric falling one on top of another. While this system for stacking is satisfactory where the next operation is done manually, it is unsatisfactory where further processing is to be done with automatic machinery. Plies falling into a well are not stacked neatly enough for later manipulation by automatic machinery, as for later separation and transfer of the plies of fabric from the stack such as by the apparatus disclosed in U.S. Pat. No. 4,157,823. Thus, there is presently a need for apparatus for neatly and efficiently stacking pieces of limp material.

Among the several objects of the invention may be noted the provision of apparatus for stacking pieces of limp material, and particularly for automatically and efficiently stacking plies of fabric or the like; the provision of such apparatus which stacks the plies neatly to facilitate later manipulation by automatic machinery; the provision of such apparatus which is capable of quickly stacking long plies; the provision of such apparatus capable of stacking the plies from a conveyor at relatively high speeds; and the provision of apparatus which automatically marks the plies for later pairing with other fabric workpieces of like color shade.

In general, apparatus of this invention for automatically stacking pieces of limp material comprises an endless conveyor having a forward traveling upper reach. The conveyor has a series of flights spaced at intervals therealong with spaces between the flights, each flight being constructed for carrying one of said pieces thereon with the piece so positioned on the flight as to have a trailing end overhanging the trailing end of the flight. The apparatus further comprises means at a stacking station along the length of the upper reach of the conveyor and below the upper reach for having pieces stacked thereon one upon another and for holding the stack, and means engageable with an upwardly facing surface of the piece for gripping the piece to stop it from moving forward. As the flight travels forward it moves out from under the piece and the piece is deposited at said station for accumulation of pieces one on top of another on said means to hold a stack.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
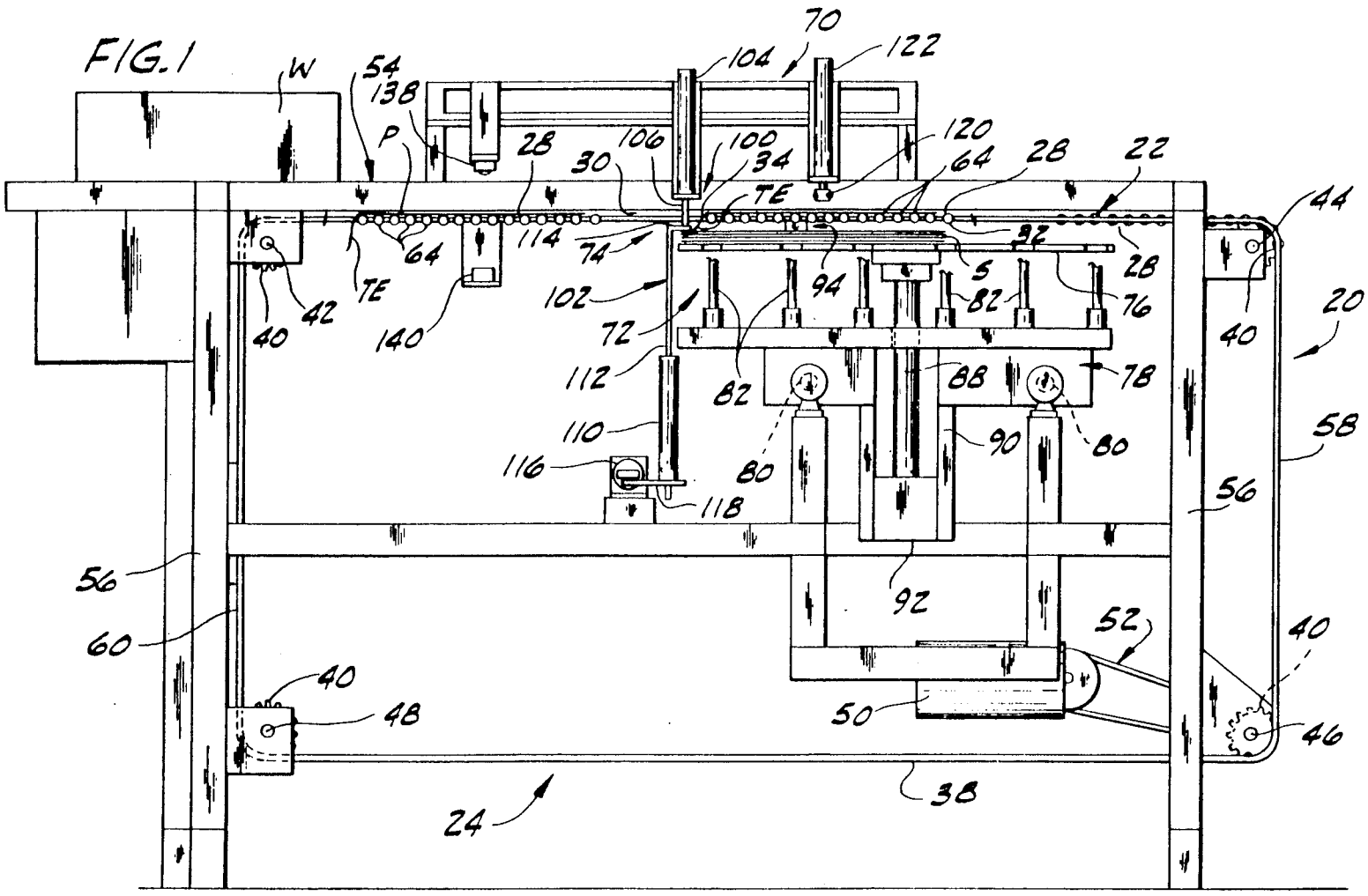
FIG. 1 is a side elevation of apparatus of this invention for automatically stacking pieces of limp material such as "plies" of fabric one on top of the other, parts being broken away to show detail.

Referring to the drawings, apparatus of this invention for stacking pieces of limp material, and particularly plies P of fabric, one on top of another in a stack S is shown to comprise an endless conveyor 20 having a forward-traveling upper reach 22, and a lower return reach 24 below the upper reach. While the apparatus is adapted particularly for stacking plies P of fabric, it is contemplated that its principles are adapted to apparatus for stacking other pieces of limp material, e.g. sheets, of tissue paper, bags, etc. The conveyor 20 is of the same general type as that disclosed in my co-pending, co-assigned U.S. application Ser. No. 07/445,539, filed Dec. 4, 1989, which is incorporated herein by reference. Briefly, the conveyor 20 is constructed to have a series of flights each designated 28 spaced at intervals therealong with spaces or openings each designated 30 between the flights. Each flight 28 is constructed for carrying one of the plies P with the ply lying on the flight. Each flight 28 has a leading edge 32 at that opening which leads the flight (in relation to the direction of travel of the conveyor 20, which is clockwise as viewed in FIG. 1), and a trailing edge 34 which trails the flight. The plies P are so positioned on the flight 28 as to have a trailing end TE overhanging the trailing edge 34 of the flight. More particularly, the conveyor 20 comprises a pair of endless chains, each designated 38, one being the left hand chain of the conveyor and the other the right hand chain of the conveyor, trained around sprockets such as indicated at 40 on a shaft 42 at the trailing end of the upper reach 22, a shaft 44 at the leading end of the upper reach, a shaft 46 below shaft 44 at the leading end of the lower reach 24, and a shaft 48 below shaft 42 at the leading end of the lower reach. Shaft 46 constitutes a drive shaft for the endless conveyor 20, being driven by suitable means such as the electric motor-speed reducer unit indicated at 50 and the chain and sprocket drive indicated at 52 in FIG. 1.

The four shafts 42, 44, 46 and 48 are journalled in suitable bearings carried by a support or frame generally designated 54 having legs 56 standing on the floor. With the arrangement shown, the conveyor 20 has a downwardly traveling forward reach 58 extending down from the leading end of its upper reach 22 to the trailing end of its lower reach 24 and an upwardly traveling rearward reach indicated at 60 extending up from the leading end of its lower reach to the trailing end of its upper reach.

Figure 2:
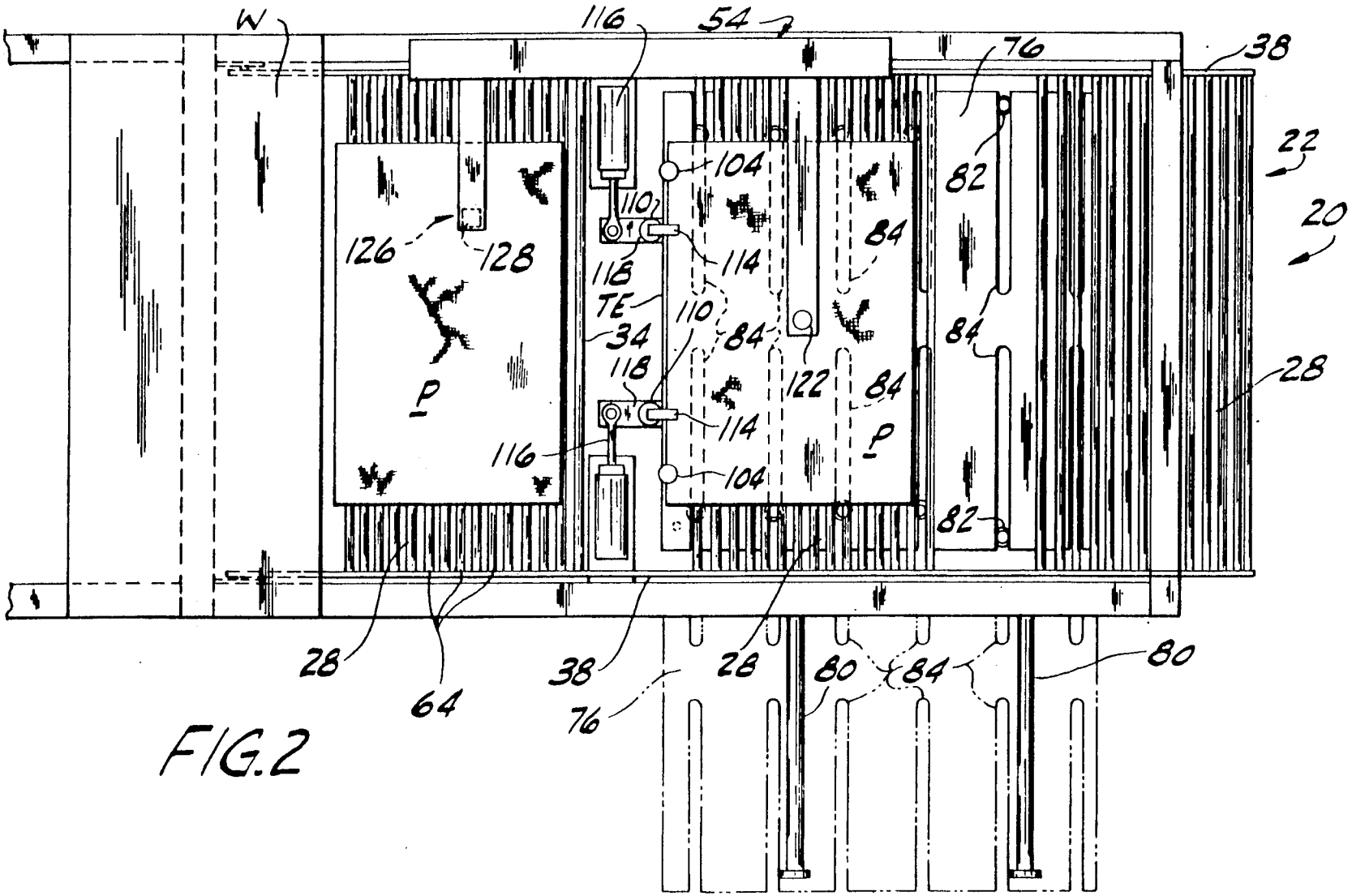
FIG. 2 is a plan of the apparatus showing in phantom a table of the apparatus for holding a stack of plies in its retracted position for unloading.

Each of the flights 28 of the endless conveyor comprises a set of rods 64 extending transversely with respect to the conveyor 20 between the left and right hand chains 38 of the conveyor. The chains 38 are typical conveyor chains made up of links pivotally interconnected for flexing of the chain, but further having pins (not shown) extending inwardly from the inside of the chain at the pivot points. The rods 64 are tubular flexible plastic rods (e.g. nylon rods) removably mounted on the pins of the conveyor chains. As illustrated in FIG. 2, each flight 28 includes several rods 64 which are relatively closely spaced longitudinally of the chains 38, but having small gaps between them. The size of the flights 28 and of the openings 30 between the flights may be changed by adding to or taking away rods. A more detailed description of the conveyor 20 with regard to the flexible rods 64 is given in U.S. application Ser. No. 07/445,539.

A stacking station, indicated generally at 70, locate along the length of the upper reach 22 of the conveyor, include means 72 below the upper reach of the conveyor for having pieces or plies P stacked thereon one upon another and for holding the stack. The stacking station 70 further includes means 74 operable as the trailing end 34 of each flight 28 with a ply P thereon enters the station for gripping the trailing end TE of the ply to stop it from moving forward, so that the flight travels forward out from under the ply and the ply is deposited at the station for accumulation of plies one on top of another on the means 72 to hold a stack. The stack-holding means 72 comprises a platen or table 76 which is substantially the same as the platen or table indicated at 49 in U.S. application Ser. No. 07/445,539. The table 76 is mounted on a carriage generally indicated at 78 which is manually movable laterally with respect to the supporting frame 54 on guides 80 between an operative position within the frame under the upper reach 22 of the conveyor 20 and a retracted unloading position, as shown in phantom in FIG. 2, facilitating the removal of the plies P stacked at the stacking station 70 from the table 76. Alignment pins for aligning the plies in the stack S are indicated at 82, these pins extending up from the carriage 78 through slots 84 in the table 76 (FIG. 2). A more detailed description of the table is given in U.S. application Ser. No. 07/445,539.

For maintaining the top ply of the stack a distance below the underside of the upper reach 22 of the conveyor 20, the table 76 is carried by the carriage 78 not only for the in and out movement relative to the frame 54 between its operative position and its retracted unloading position, but is also carried by the carriage for vertical movement relative to the carriage, with means for moving it downwardly as plies P are stacked onto the table to maintain the top ply at a generally constant level beneath the upper reach of the conveyor. For this purpose, the table 76 is movable up and down with respect to the carriage 78 by the screw 88 of an electric-motor-driven ball screw mechanism 90 carried as indicated at 92 by the carriage, the screw extending down from the table. The arrangement is such that on operation of the motor of the ball screw mechanism 90 to turn the nut (not shown) of the mechanism in one direction, the screw 88 and the table 76 are raised, and on operation of the motor to turn the nut in the other direction the screw and the table are lowered. Sensing means comprising eye means, generally indicated at 94, is provided for sensing the position of the top of the stack S relative to the upper reach 22 of the conveyor. The eye means 94 includes a light source 95 and an electric eye 96. When the stack S becomes high enough, the light from the light source 95 is blocked from the electric eye 96, and a signal is generated by the eye which, as will be explained more fully below, causes the ball screw mechanism 90 to lower the table 76 to maintain the top ply a predetermined distance below the upper reach 22 of the conveyor.

Figures 4, 5, 6, 7:
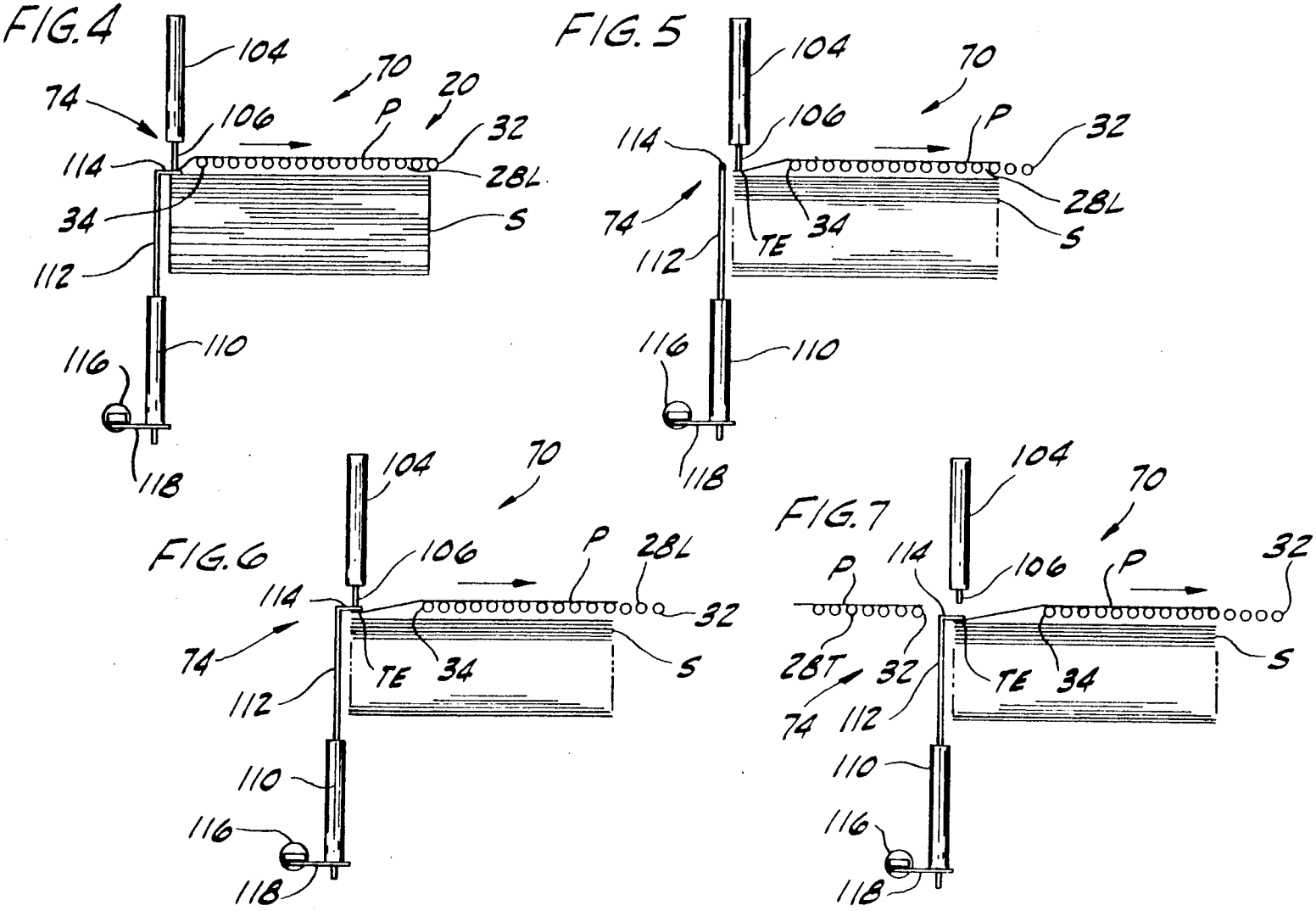

The gripping means 74 includes means 100 movable downwardly through the spaces or openings 30 between flights 28 as the trailing ends 34 of the flights enter the stacking station 70 for pinning down each piece, and means 102 located underneath the upper reach 22 clamping down on top of the stack at the rear end of the stack. The clamping means 102 is movable between a clamping position (FIG. 4) over the stack and a retracted position (FIG. 5) clear of the stack. The clamping means 102 is also movable downwardly from its position shown in FIG. 6 to its clamping position shown in FIG. 7 for clamping down the stack. The pinning means 100 comprises a first pair of generally vertically oriented air cylinders 104 having extensible and retractable pins 106. The pinning cylinders 104 are mounted on the frame 54 above the upper reach 22 of the conveyor. The clamping means 102 comprises a second pair of air cylinders 110 pivotally mounted in generally vertical orientation on the frame 54 underneath the upper reach 22 of the conveyor. The clamping cylinders 110 each include an extensible and retractable rod or arm 112 having a laterally projecting finger 114 adapted to extend over the rear end of the stack S and to engage the rear end of the stack for clamping down the stack. The clamping means 102 further comprises a third pair of air cylinders 116 mounted on the frame 54 in a horizontal orientation transverse to the direction of travel of the conveyor 20 underneath the upper reach 22 of the conveyor. The pivoting cylinders 116 are each connected to the bottom of a respective clamping cylinder 110 by a connecting link 118 for pivoting the respective clamping cylinder about its longitudinal (vertical) axis. Retraction of the pivoting cylinders moves the fingers 114 of the clamping cylinder arms 112 from the clamping position, in which the fingers extend over the stack (FIG. 4), to the retracted position, in which the fingers are clear of the stack (FIG. 5).

Figure 9:
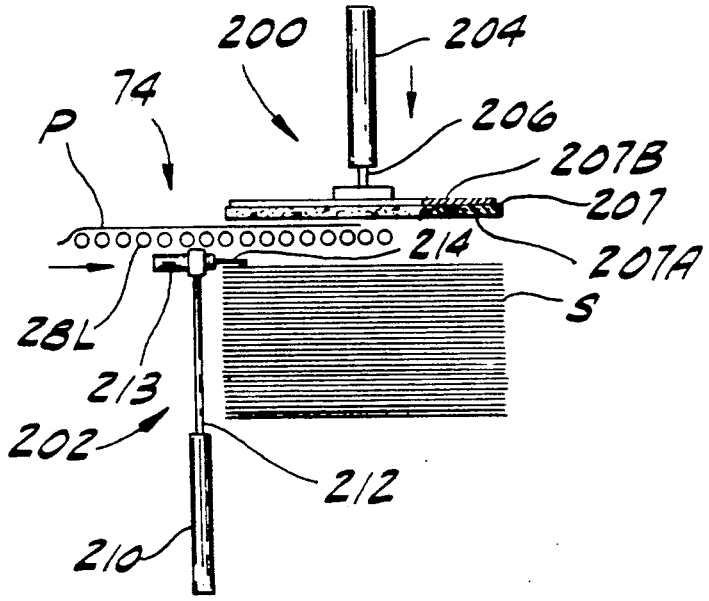
FIG. 9 is an elevation of apparatus of a second embodiment.
Figure 10:
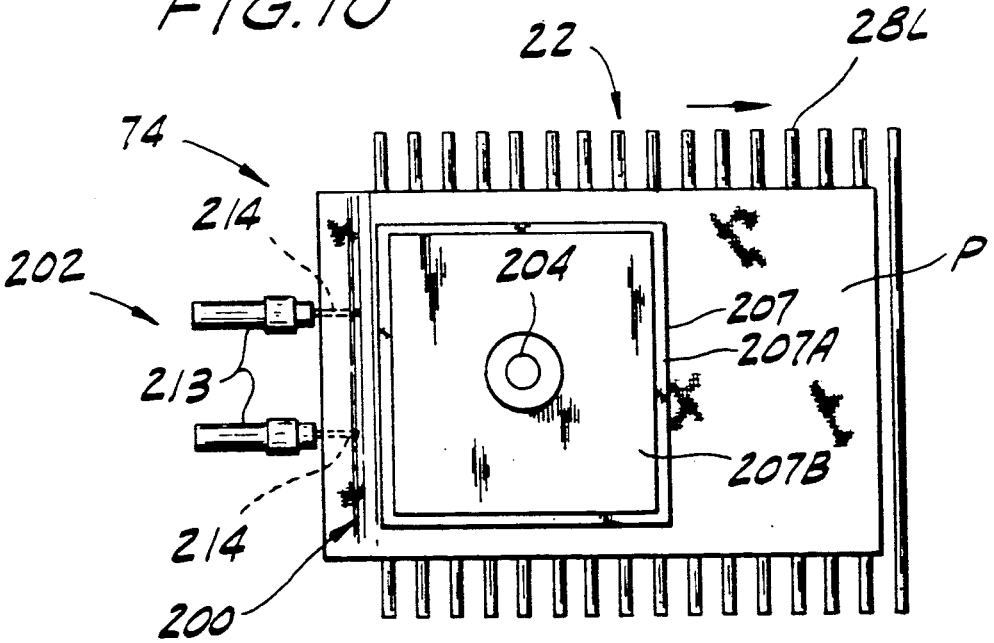
FIG. 10 is a top plan view of the apparatus of FIG. 9.

A second embodiment of the apparatus of the present invention, shown in FIGS. 9 and 10, has a different form of the gripping means 74 which includes means 200 movable downwardly into engagement with a portion of an upwardly facing surface of the ply P overlying the flight and means 202 located underneath the upper reach 22 clamping down on the top of the stack at the rear of the stack. Movable means 200 comprises a generally vertically oriented air cylinder 204 mounted on the frame 54 above the upper reach 22 of the conveyor having an extensible and retractable pin 206. A gripping pad 207 including a pad 207A of high friction material, such as foamed rubber mounted on a rigid backing plate 207B, is mounted on the lower end of the pin 206. The clamping means 202 comprises a pair of cylinders 210 (only one is shown) mounted in generally vertical orientation on the frame 54 underneath the upper reach 22 of the conveyor. The clamping cylinders 210 each include an extensible and retractable rod or arm 212 having a laterally extending cylinder 213 mounted on its distal end. As with the apparatus of the first embodiment, the clamping means 202 is movable downwardly to clamp down the stack upon retraction of the arms 212. Each cylinder 213 has an extensible and retractable finger 214 adapted in its extended position over the rear end of the stack S to engage the rear end of the stack for clamping down the stack. In its retracted position, the finger 214 is clear of the stack, such that the clamping means 202 is movable, between a clamping position over the stack and a retracted position clear of the stack.

The apparatus of the present invention also automatically carries out a marking operation on the plies P so that the plies may be matched up with other pieces cut from the same roll of fabric to form the article of apparel. There are inherent variations in the shade of color of the fabric each time a new length of fabric is dyed, even though the same type of fabric and the same dye are used. In order to prevent the appearance of color variations in the article of apparel (called "shading") the component pieces of the article of apparel must be cut from a length of fabric dyed in a single dying process. However, after cutting these pieces may go separate ways as various operations are carried out on them prior to final assembly of the article of apparel. Therefore, it is necessary to mark the pieces so that when, for instance, a shirt is assembled, the collar and the sleeve may be easily recognized as having been cut from the same length of fabric. To this end, marking means indicated generally at 120 is provided for marking the top ply in the stack S. The marking means is mounted on a cylinder 122 above the conveyor and the stack, and is movable downwardly to engage the ply for marking the ply. The marking means 120 is pneumatically operated and may either apply a self adhesive sticker to the ply or mark the ply with ink. The marking means in this embodiment is the Tovel Model TPG Dual Line Printer made by Tovel SPA of Venezia, Italy, and available in this country through Tennessee Imports, Inc. of Nashville, Tenn., which applies stickers (not shown) to the plies.

Figure 8:
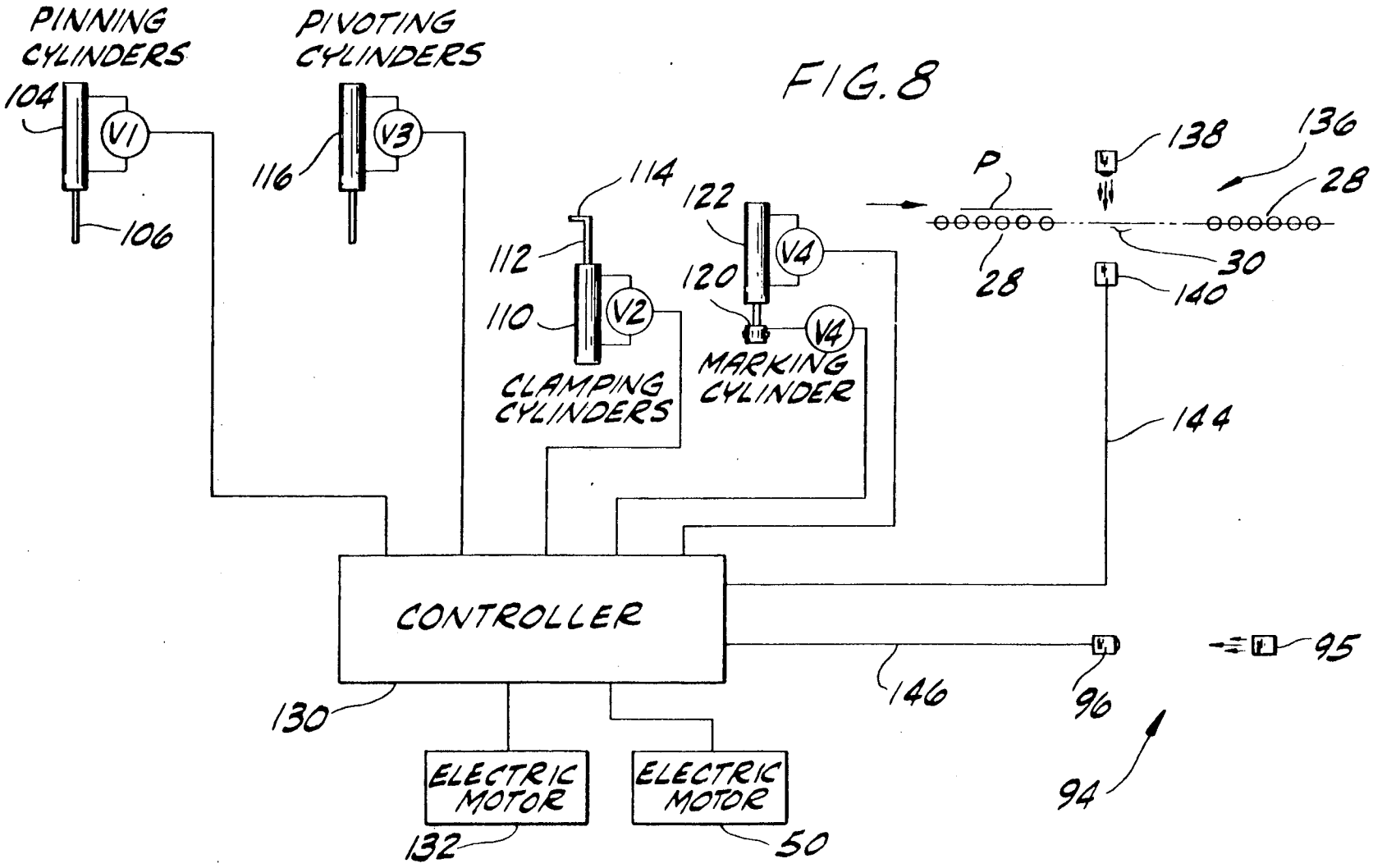
FIG. 8 is a diagramatic view illustrating circuitry of the apparatus.

The apparatus is under the control of a programmable controller such as indicated at 130 in FIG. 8, which may be a Shark X-903 controller sold by Reliance Electric Corp. through their dealers in their major cities. This controls valves V1, V2, V3, and V4 for the air cylinders 104, 110, 116, and 122, the marking means 120, and the motor of the ball screw mechanism 90 as indicated at 132. Although not shown, in the second embodiment the valve V1 would operate the gripping pad cylinders 204 rather than the pinning cylinders 104, and the valve V3 would operate the laterally extending cylinders 213 rather than the pivoting cylinders 116. At 136 is indicated means for sensing the passage of a piece or ply P over a point rearward (relative to the forward direction of travel of the upper reach 22 of the conveyor 20) of the stacking station 70, this means being an electric eye means having a light source 138 which projects a beam of light toward the upper reach 22 of the conveyor, the beam impinging on an electric eye 140 except when a ply passes between the light source and eye. The eye means 136 is of the type having a built-in delay so that it is not activated by the passage of the rods 64 making up the conveyor flights 28 through the beam. The eye means 136 is activated when the trailing edge TE of each ply clears the beam of light from the light source 138 so that the beam again impinges upon the eye 140 which transmits a signal to the controller 130 over a line 144 to initiate a cycle of operation of the gripper means 74 and marking means 120, as described below. Similarly, the electric eye 96 of eye means 94 is connected to the controller 130, such that if the stack S becomes high enough to obstruct the light from the light source 95, the electric eye 96 sends a signal over a line 146 to the controller which activates the ball screw mechanism 90 to lower the table 76 until the top of the stack reaches a predetermined level.

Figure 3:
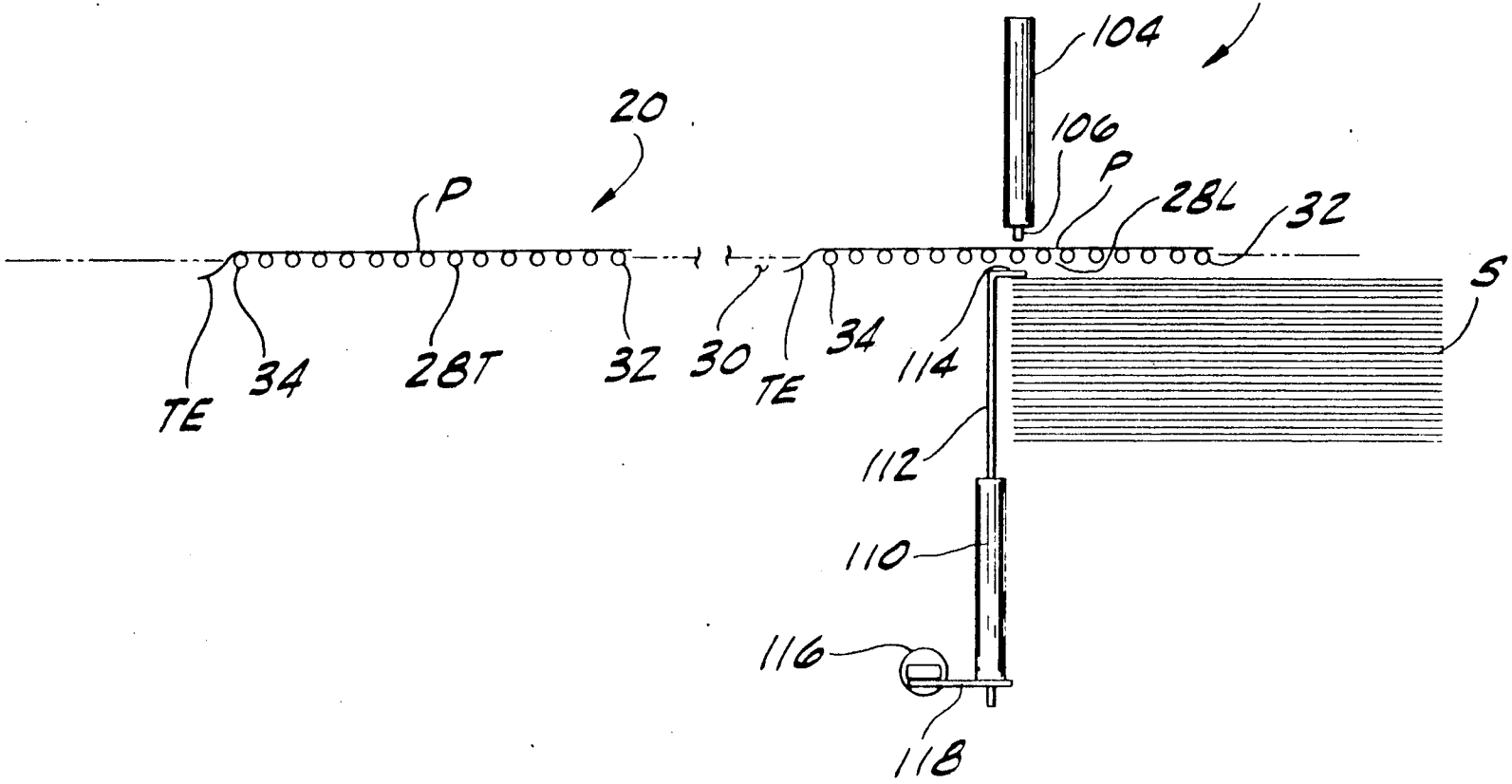
FIGS. 3–7 are schematic illustrations showing the function of the apparatus.

For purposes of illustration, the plies P are shown as being individually fed onto one of the conveyor flights 28 from a work station W (e.g., a sewing station) at the left end of the frame 54 as shown in FIG. 1. One stacking cycle of operation of the apparatus of the first embodiment of the present invention for is illustrated in FIGS. 3–7. As shown in FIG. 3 a leading flight 28L of the conveyor carries a piece or ply P of limp material into the stacking station 70. As stated, the cycle of operation of the gripper means 74 is initiated by the passage of the ply P on the leading flight 28L under the eye means 136 located rearwardly of the stacking station 70. Under control of the controller 120, and on a time basis the valve V1 is activated to actuate the pinning cylinders 104 to extend their pins 106 downwardly against the trailing end TE and through the opening 30 in the conveyor to pin the trailing end against the top of the stack S. Thus, the ply P is held from moving forward with the leading flight 28L so that the flight begins to move out from under the ply. As shown in FIG. 4, the fingers 114 of the arms 112 of the clamping cylinders 110 extend over the rear end of the stack and are in clamping engagement with the rear end of the stack. However, the fingers 114 are located underneath the ply pinned against the stack by the pins 106 and do not clamp the ply. The controller 130 activates valve V3 to actuate the pivoting cylinders 116 for pivoting the clamping cylinders 110 on their longitudinal (vertical) axes to swing the fingers 114 to their retracted position, clear of the stack, as shown in FIG. 5. The valve V2 is activated by the controller 120 to extend the rods or arms 112 of the clamping cylinders, moving the fingers 114 slightly upwardly. The valve V3 is reactivated to swing the fingers 114 to their clamping position over the stack (FIG. 6) and the valve V2 is reactivated to bring the fingers down against the trailing end TE of the ply (FIG. 7). The trailing end TE of the ply is now clamped against the stack S and held from moving forward with the leading flight 28L by the fingers 114 and the pins 106. The controller 130 next reactivates the valve V1 to actuate the pinning cylinders 104 to retract the pins 106, leaving it to the fingers 114 to hold the ply from moving forward with the flight (FIG. 7). The fingers 114 continue to hold the ply so that as the leading flight 28L continues to move forward, it moves out from under the ply, and the ply is deposited on the stack. Retraction of the pins 106, which had been extended through the opening 30 in the conveyor allows the next or "trailing" flight 28T to enter the stacking station 70 prior to completion of the transfer of the ply P from the leading flight 28L to the stack. This feature minimizes the time required to stack long plies.

A cycle of operation of the apparatus of the second embodiment of the present invention is substantially the same as that of the first embodiment except where noted hereinafter. After detection of the ply P by the eye means 136, the controller 130 activates the valve V1 to actuate the gripping pad cylinder 204 to extend its pin 206 downwardly so that the gripping pad 207 engages a portion of the ply overlying the leading flight 28L. Engagement of the pad 207A of high friction material with the upwardly facing surface of the ply P stops the forward movement of the ply with the flight 28L because the frictional engagement of the ply with the pad is greater than the frictional engagement with the conveyor flight, and the flight 28L begins to slide out from under the ply with the ply being deposited on the stack S. As with the fingers 104, the fingers 204 of the clamping means 202 of the second embodiment extend over the rear of the stack and are in clamping engagement with the stack. As the ply P is deposited on the stack S, the fingers 204 are underneath the ply and do not clamp the ply (FIG. 10). The controller 130 activates the valve V3 to actuate the finger cylinders 213 to retract the fingers 214 to a position clear of the stack S. The clamping cylinders 210 are then operated in the same fashion as the clamping cylinders 110 to raise the finger above the ply. The valve V3 is reactivated to extend the finger 214 over the stack and the clamping cylinders 210 move the finger down again into clamping engagement with the stack. Thereafter, the ply P is held by the fingers 214 of the clamping means 202 so that the gripping pad 207 may be raised up to make room for the ply on the next or trailing flight 28T to enter the stacking station 70.

The marking means 120 is also controlled on a time basis by the controller 130 so that the marking means is activated after the signal to the controller from the eye means 136 to present a sticker (not shown) having the next sequential number marked thereon to be adhered to the ply P. The timing of the activation of the marking cylinder 122 may be set so that the marking means moves downwardly engaging the ply while it is still supported by the leading flight 28L. As one alternative, the timing of the activation of the marking cylinder may be set to coincide with the passage of the opening 30 in the conveyor under the marking cylinder. In the latter instance, the marking cylinder 122 is extended so that the marking means 120 passes through the opening 30 and engages the ply P on the top of the stack S. In either case, the pressure of the engagement of the marking means 120 with the ply adheres the sticker to the ply. The marking cylinder is then reactivated to retract the marking means 120 from the ply to its position above the conveyor 20.

One application of the principles of the apparatus described herein is in the alternate stacking of left and right pieces. A common method for cutting pieces for a particular apparel item involves "fan-folding" a roll of fabric onto a cutting table by passing the roll back and forth across the table while letting out fabric onto the table to form the spread. The pattern for the ply required (e.g., for producing a shirt collar) is placed on the top surface of the spread, and the spread is cut through all of its layers resulting in the stack of plies. Because the fabric was fan-folded prior to cutting the plies, adjacent plies in the stack are mirror images of each other (i.e., "left" plies and "right" plies). The plies are then fed individually from the stack into a work station such as sewing station W. It is ultimately necessary to bring together the left plies and the right plies in separate stacks of the like plies. To this end apparatus (not shown) constructed according to the principles of the present invention is provided including two stacking stations, one downstream relative to the direction of travel of the conveyor from the other. Each stacking station would be identical to the stacking station 70 described above, including the gripper means 74. In this embodiment, the controller would include a flip-flop circuit so that the gripper means 74 at each station would be operable only upon passage of every other ply under the respective eye means 136 at the stacking stations. Therefore, the first stack will contain only left or only right plies, while the second stack formed will contain only the opposite type of ply. Two marking means identical to the marking means 120 described above may also be provided for marking the plies in each stack.

It will be observed that on operation of the conveyor (usually continuously) plies passing into the stacking station are automatically and efficiently pinned or clamped at their trailing ends so that the flights carrying them move out from under the plies to neatly stack the plies, such as is particularly desirable for later handling of the plies by automatic machinery. For instance, the apparatus of the present invention may be used in conjunction with the apparatus disclosed in U.S. application Ser. No. 07/445,539. Because the pinning cylinders 104 (or gripping pad cylinder 204) work in tandem with the clamping cylinders 110 (or clamping cylinders 210) to alternately hold the ply from forward motion, the openings 30 between the flights may be smaller than the length of the plies. Minimizing the spacing between the flights carrying the plies increases the frequency with which the plies are stacked at a given conveyor speed. The apparatus is capable of operating at relatively high speeds while still stacking the plies neatly on the table. The speed of the conveyor may be varied by varying the speed of the motor 50, and the timing of the gripper means 74 may be correlated with the conveyor speed (note the interconnection indicated in FIG. 8 at 140 between motor 50 and the controller 130). Further, the operation of marking the plies for later matching with other pieces cut from the same length of fabric for final assembly of an article of apparel is automatically performed by the marking means 120 and marking cylinder 122 of the invention. Thus, another operation (marking of the plies) which is normally done by hand is quickly and efficiently carried out by this apparatus.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for stacking pieces of limp material comprising:

an endless conveyor having a forward-traveling upper reach;

said conveyor having a series of flights spaced at intervals therealong with spaced between the flights;

each flight being constructed for carrying one of said pieces thereon;

means at a stacking station along the length of the upper reach of the conveyor and below the upper reach for having pieces stacked thereon one upon another and for holding the stack; and means engageable with an upwardly facing surface of the piece for gripping the piece to stop it from moving forward sot that the flight travels forward out from under the piece and the piece is deposited at said station for accumulation of pieces one on top of another on said means to form a stack, the gripping means comprising means movable downwardly through the spaces between flights as the trailing ends of the flights enter said station for pinning down each piece, the gripping means further comprising means located underneath the upper reach clamping down on top of the stack at the rear end of the stack, said clamping means being movable between a clamping position over the stack and a retracted position clear of the stack and movable downwardly when in clamping position for clamping down the stack.

2. Apparatus as set forth in claim 1 wherein the means for holding the stack comprises a vertically movable table and wherein means is provided for lowering the table as pieces are accumulated in a stack thereon to maintain the top piece generally a predetermined distance under the upper reach of the conveyor.

3. Apparatus as set forth in claim 1 further comprising means for sensing passage of a piece past a point rearward of the stacking station and activating the gripper means on the passage of each piece past the point.

4. Apparatus as set forth in claim 1 further comprising marking means for automatically marking the piece after it has been deposited on the stack.

5. Apparatus as set forth in claim 4 wherein said marking means is movable downwardly through one of the openings in the conveyor for applying the marker.

6. Apparatus as set forth in claim 1 further comprising marking means for automatically marking the piece as it is supported on one of the flights.

7. Apparatus for stacking pieces of limp material comprising:

an endless conveyor having a forward-traveling upper reach;

said conveyor having a series of flights spaced at intervals therealong with spaces between the flights;

each flight being constructed for carrying one of said pieces thereon;

means at a stacking station along the length of the upper reach of the conveyor and below the upper reach for having pieces stacked thereon one upon another and for holding the stack; and means engageable with an upwardly facing surface of the piece for gripping the piece to stop it from moving forward so that the flight travels forward out from under the piece and the piece is deposited at said station for accumulation of pieces one on top of another on said means to form a stack, said gripping means comprising means movable downwardly into engagement with a portion of the upwardly facing surface of the piece overlying the flight, said movable means comprising a gripping pad made of high friction material for engagement with the piece whereby the frictional engagement of the gripping pad with the piece is greater than the frictional engagement of the piece with the flight.

8. Apparatus as set forth in claim 7 further comprising marking means for automatically marking the piece as it is supported on one of the flights.

9. Apparatus as set forth in claim 8 wherein said marking means is adapted to mark the piece after it is deposited on the stack.

10. Apparatus for stacking pieces of limp material comprising:

an endless conveyor having a forward-traveling upper reach;

said conveyor having a series of flights spaced at intervals therealong with spaces between the flights;

each flight comprising a series of elongated support means extending transversely of the direction of travel of the conveyor, said support means being arranged in closely spaced relationship and allowing passage of light between adjacent support means, each flight being constructed for carrying one of said pieces thereon;

means at a stacking station along the length of the upper reach of the conveyor and below the upper reach for having pieces stacked thereon one upon another and for holding the stack;

means engageable with an upwardly facing surface of the piece for gripping the piece to stop it from moving forward so that the flight travels forward out from under the piece and the piece is deposited at said station for accumulation of pieces one on top of another on said means to form a stack;

means for sensing passage of a piece past a point rearward of the stacking station and activating the gripper means on passage of each piece past the point, said sensing means being disposed for shining a beam of light through the upper reach of the conveyor, said sensing means being adapted to distinguish between passage through said beam of one of said support means forming the flights and a piece for purposes of activating the gripper means.

* * * * *